US008490967B2

(12) United States Patent
Takada et al.

(10) Patent No.: US 8,490,967 B2
(45) Date of Patent: Jul. 23, 2013

(54) MEDIUM STORING AND ADVANCING APPARATUS

(75) Inventors: Atsushi Takada, Gunma (JP); Masayuki Nakashima, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/494,181

(22) Filed: Jun. 12, 2012

(65) Prior Publication Data

US 2012/0247921 A1 Oct. 4, 2012

Related U.S. Application Data

(63) Continuation of application No. 12/737,392, filed on Jan. 7, 2011, now Pat. No. 8,267,398.

(30) Foreign Application Priority Data

Jul. 9, 2008 (JP) ..... 2008-179600

(51) Int. Cl.
*B65H 43/04* (2006.01)
*B65H 29/68* (2006.01)

(52) U.S. Cl.
USPC ..... 271/198; 271/69; 271/264; 271/314

(58) Field of Classification Search
USPC ..... 271/198, 264, 69, 314
See application file for complete search history.

(56) References Cited

U.S. PATENT DOCUMENTS

| | | | |
|---|---|---|---|
| 5,147,092 | A | 9/1992 | Driscoll et al. |
| 5,342,038 | A | 8/1994 | Suter |
| 5,775,689 | A | 7/1998 | Moser et al. |
| 6,203,006 | B1 | 3/2001 | Semanick et al. |
| 7,806,402 | B2 | 10/2010 | Sato et al. |

FOREIGN PATENT DOCUMENTS

| | | | |
|---|---|---|---|
| CN | 101044515 | A | 9/2007 |
| JP | 56-088039 | | 7/1981 |
| JP | 57032170 | A * | 2/1982 |
| JP | 63-127970 | | 5/1988 |
| JP | 63-267658 | | 11/1988 |
| JP | 2-119467 | | 9/1990 |
| JP | 3-148791 | | 6/1991 |
| JP | 2004-256231 | | 9/2004 |

* cited by examiner

*Primary Examiner* — Luis A Gonzalez
(74) *Attorney, Agent, or Firm* — Rabin & Berdo, P.C.

(57) ABSTRACT

To provide a medium storing and advancing apparatus which orderly piles up bills even when not flat. The medium storing and advancing apparatus includes a tongue piece roller having tongue pieces having the length thereof predetermined. While the tongue piece roller is rotated to slap the rear end of a bill with the tongue pieces to orient the latter downward, the front end of a following bill is superimposed on the downward-oriented rear end of the preceding bill.

9 Claims, 4 Drawing Sheets

MEDIUM STORING AND ADVANCING APPARATUS

This is a Continuation of U.S. application Ser. No. 12/737,392, filed on Jan. 7, 2011, now U.S. Pat. No. 8,267,398 the subject matter of which is incorporated herein by reference.

TECHNICAL FIELD

The present invention relates to a medium storing and advancing apparatus which stores and advances a medium such as a bill, a check, or securities, and more particularly to a bill depositing and withdrawing machine, a check/securities retrieving and issuing machine, and a bill/check/securities receiving and delivering apparatus which are included in automatic transaction apparatuses and the like in financial institutions.

BACKGROUND ART

For example, as disclosed in the paragraphs 0019 to 0025 and FIG. 1 of Japanese Patent Laid-Open Publication No. 82004-256231, a conventional medium storing and advancing apparatus includes a first conveyance channel extending from the inside of a medium discharge mechanism to a discharge slot and a second conveyance channel confluent from obliquely beneath on the way of the first conveyance channel, and feeds out media such as bills in such a manner as to transfer a plurality of stored media from the second to the first conveyance channel to accumulate them short of the discharge slot, and discharge them from the discharge slot.

However, the above conventional art involves a problem that, when a plurality of bills are transferred in series from the second to the first conveyance channel with preceding one of the bills not being flat, for example, with the rear end, viewed from the discharge slot, of the preceding bill folded or with the preceding bill curled up, the following bill knocks the preceding bill, thus making it impossible to orderly pile up them, and therefore to cause a failure in accumulation of bills, i.e. a so-called accumulation jam.

SUMMARY OF THE INVENTION

It is an object of the present invention to solve such a disadvantage in the conventional art to provide a medium storing and advancing apparatus which orderly piles up bills even when preceding one of the bills is not flat.

The medium storing and advancing apparatus according to the present invention includes a tongue piece roller having tongue pieces having the length thereof predetermined. While the tongue piece roller is rotated to slap the rear end of a bill with the tongue pieces to orient the latter downward, the front end of the following bill is superimposed on the downward-oriented rear end of the preceding bill.

Therefore, in accordance with the present invention, it is possible to orderly pile up media which are not flat.

BRIEF DESCRIPTION OF THE DRAWINGS

The objects and features of the present invention will become more apparent from consideration of the following detailed description taken in conjunction with the accompanying drawings in which.

BEST MODE FOR IMPLEMENTING THE INVENTION

Next, an embodiment of a medium storing and advancing apparatus 10 according to the present invention will be described in detail with reference to the accompanying drawings.

Figure 1:
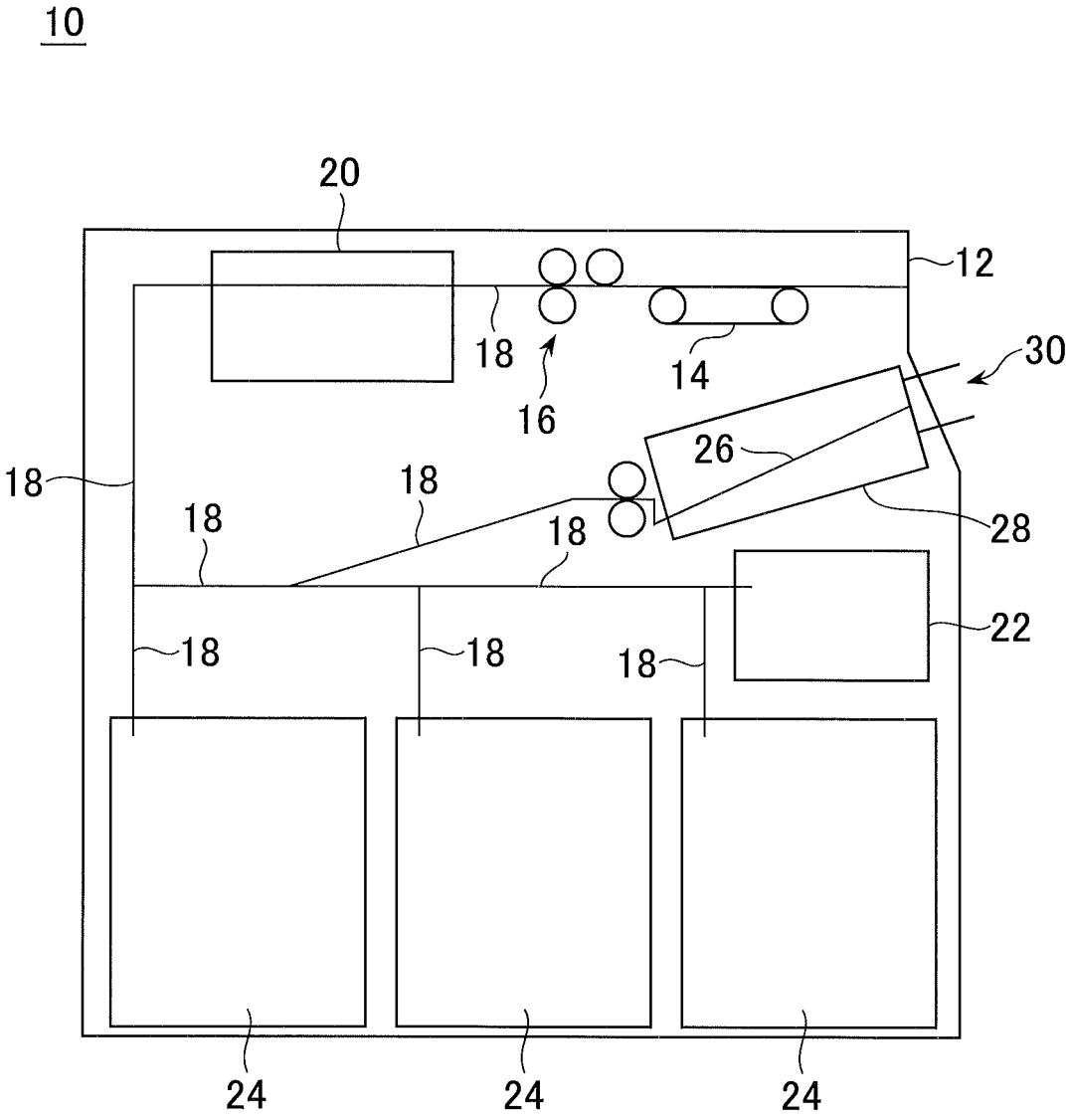
FIG. 1 is a schematic side view showing the main part of an embodiment of a medium storing and advancing apparatus according to the present invention.

FIG. 1 schematically shows in a side view the main part of the embodiment of the medium storing and advancing apparatus according to the present invention. In FIG. 1, the medium storing and advancing apparatus 10 includes, as shown in the figure, a bill inlet/outlet 12, a conveyor belt 14, a feeder 16, a conveyance channel 18, a discriminator 20, a temporary storage 22, bill storage boxes 24, a returning conveyance channel 26, a returning and accumulating section 28 and a discharge slot 30, and is adapted to store media and feed out them. In the present embodiment, the medium storing and advancing apparatus 10 is a bill processing apparatus for storing and feeding out bills serving as media, and is built in an automatic transaction apparatus installed in a branch office or the like of a financial institute.

The bill inlet/outlet 12 is arranged for inputting bills thereinto from, and discharging bills therefrom to, the outside of the medium storing and advancing apparatus 10. In the present embodiment, the bill inlet/outlet 12 may receive a single bill or a bundle of a given number of bills. Further, when bills are discharged, i.e. withdrawn from the medium storing and feeding-out apparatus 10, they are withdrawn in lump from the bill inlet/outlet 12. The conveyor belt 14 has a function of delivering the bills input into the bill inlet/outlet 12 to the feeder 16. Thus, the bills input into the bill inlet/outlet 12 are fed to the feeder 16 by the conveyor belt 14.

The feeder 16 has a function of separating the bills input into the bill inlet/outlet 12 from each other. In this way, the medium storing and feeding-out apparatus 10 feeds the bills input from the bill inlet/outlet 12 to the inside of the medium storing and feeding-out apparatus 10 on the conveyor belt 14 via the feeder 16.

The conveyance channel 18 serves as conveying the bills individually fed out by the feeder 16 to the sections of the medium storing and feeding-out apparatus 10. In the embodiment, the conveyance channel 18 communicates, as shown in FIG. 1, with the discriminator 20, the temporary storage 22, and the bill storage boxes 24. On the way of the conveyance channel 18, a plurality of blades, not shown, are disposed, which are moved so as to switch the conveying direction of the bills to thereby cause the conveyance channel 18 to feed the bills to the sections such as the discriminator 20, the temporary storage 22 and the bill storage boxes 24.

The discriminator 20 has a function of discriminating among individual bills conveyed on the conveyance channel 18 from the feeder 16. In the present embodiment, the discriminator 20 determines the authenticity of the bills, whether or not the bills are damaged, whether or not the bills are mechanically scannable, the denominations and the like.

The temporary storage 22 is a place for temporarily storing bills discriminated by the discriminator 20. The bill storage boxes 24 are adapted for storing bills therein. In the present embodiment, the bill storage boxes 24 are provided in plural, each of which is adapted in advance for use in storing bills exclusively for a predetermined denomination. Thus, each bill storage box 24 will store bills of a predetermined denomination.

The conveyance channel 18 is connected to the returning conveyance channel 26 at a position on the way, to feed a bill determined unauthentic by the discriminator 20, i.e. so-called rejected bill, to be discharged from the discharge slot 30. The rejected bill is, for example, a bill indefinite in denomination, counterfeit bill and the like. The returning conveyance channel 26 is connected with the conveyance channel 18 to receive a rejected bill conveyed over the conveyance channel 18 to feed it to the discharge slot 30. In the present embodiment, the returning conveyance channel 26 exists in the returning and accumulating section 28, and is adapted to convey the rejected bill, when received from the conveyance channel 18, to the discharge slot 30. The returning and accumulating section 28 has a function of accumulating rejected bills, which will be piled up therein to be discharged from the discharge slot 30.

Figure 2:
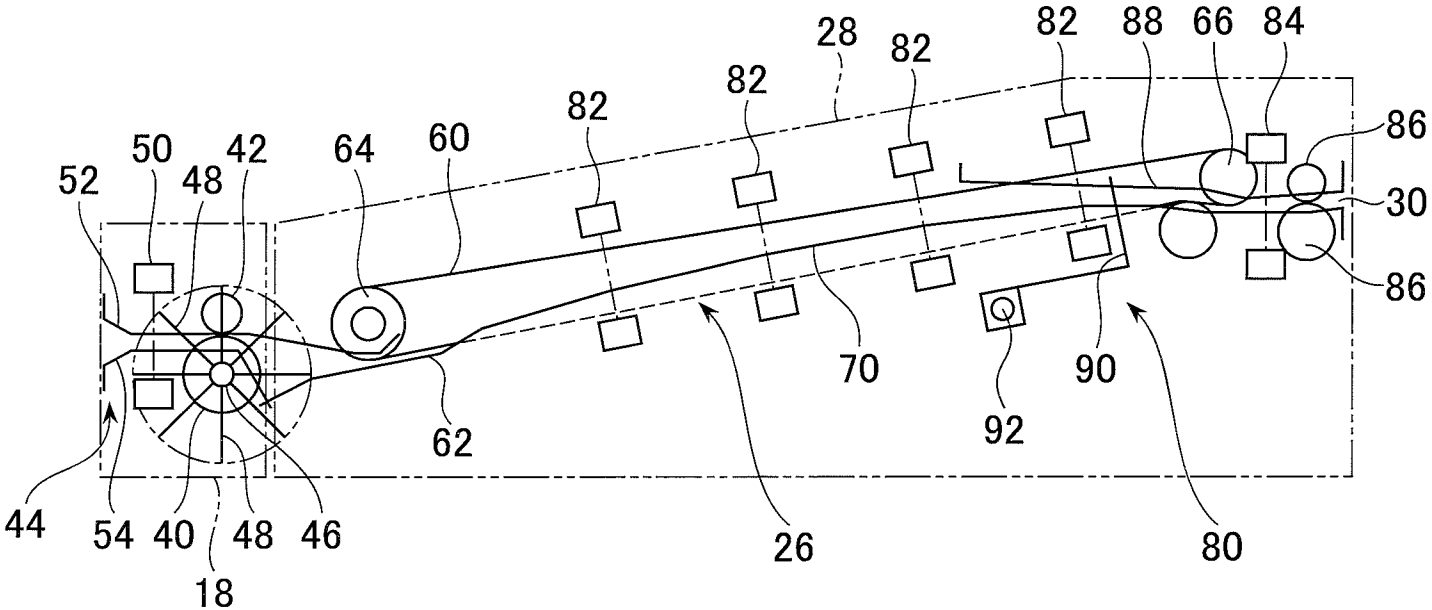
FIG. 2 is an enlarged view schematically showing a returning and accumulating section and conveyance channels in the embodiment of FIG. 1.

With reference to FIG. 2, the conveyance channel 18, the returning conveyance channel 26 connected therewith and the discharge slot 30 will be described in detail. In FIG. 2, the same reference numerals as in FIG. 1 denote like components to avoid redundant descriptions. At the position where the conveyance channel 18 and the returning conveyance channel 26 are connected with each other, i.e. at the end of the conveyance channel 18 on the side of the returning and accumulating section 28, a feed roller 40, a driven roller 42, and a conveyance guide 44 are disposed, as shown in FIG. 2, so as to transferring the rejected bill conveyed from the conveyance channel 18 to the returning and accumulating section 28.

The feed roller 40 is disposed at the place at which the conveyance channel 18 and the returning conveyance channel 26 are connected with each other, i.e. at the end of the conveyance channel 18 on the side of the returning and accumulating section 28, so as to be rotated by a driving source, not shown. The feed roller 40 includes a tongue piece roller 46, which is attached coaxially with the feed roller 40 and has a plurality of tongue pieces 48 made of an elastic material such as natural or synthetic rubber formed on its outer circumference. The tongue pieces 48 are so hard as to be deformable in order not to interfere with the conveyance of a bill when touching the pieces. The length thereof, i.e. the length in the same direction as the radial direction of the tongue piece roller 46 is approximately equal to the length allowing the rear edge of a rejected bill, when delivered from the conveyance channel 18 to the returning conveyance channel 26, to be pressed. In detail, the length of the tongue pieces 48 in the present embodiment is designed such that their leading ends are located inwardly to the returning conveyance channel 26 from the end of the returning conveyance channel 26 on the side of the conveyance channel 18.

The driven roller 42 is disposed so as to mate the feed roller 40 above the feed roller 40, and includes a spring member, not shown, thereby pressing the feed roller 40, so as to be driven with the feed roller 40 to pinch a bill against the feed roller 40 to convey it.

The conveyance guide 44 includes a pair of upper and lower guide plates 52 and 54, and has a function of guiding a rejected bill pinched to be conveyed by the feed roller 40 and the driven roller 42. Both upper and lower guide plates 52 and 54 extend to the returning and accumulating section 28 so as to overlap with the end of the returning conveyance channel 26 on the side of the conveyance channel 18 in the returning and accumulating section 28.

In addition, the conveyance channel 18 is further provided with a sensor 50 on the way, thereby sensing a bill being conveyed to the returning and accumulating section 28. In the present embodiment, the sensor 50 is an optical sensor, which has a light-emitting element and a light-sensitive element, and detects when the light from the light-emitting element is blocked by a rejected bill to determine the bill being conveyed to the returning and accumulating section 28.

The returning conveyance channel 26 is composed of a conveyor belt 60 and a returning conveyance guide 62 installed under the conveyor belt 60. The conveyor belt 60 has flexibility, and is wound in a loop on two rollers 64 and 66, which are respectively installed upstream in the conveying direction, i.e. on the side of the conveyance channel 18, and downstream in the conveying direction, i.e. on the side of the discharge slot 30e. In addition, toward the roller 64, the upper guide plate 52 of the conveyance guide 44 in the conveyance channel 18 is extended.

The returning conveyance guide 62 is disposed so as to face the conveyor belt 60 under the conveyor belt, and extends from the end of the return accumulating section 28 on the side of the conveyance channel 18 to the discharge slot 30. In the instant embodiment, the returning conveyance guide 62 touches the lower guide plate 54 of the conveyance guide 44 in the conveyance channel 18. In detail, in the present embodiment, the lower guide plate 54 has such a shape as to decline over the position, at which the feed roller 40 and the driven roller 42 pinch a bill, to touch the returning conveyance guide 62 at its tip thus declining. In addition, in the example shown in FIG. 2, the conveyance channel 18 is disposed higher than the returning conveyance channel 26, i.e. the returning conveyance guide 62. In other words, the returning conveyance guide 62 is located such that the end upstream in the conveying direction, i.e. the end on the side of the conveyance channel 18, is lower than the conveyance channel 18. Therefore, a bill fed by the feed roller 40 and the driven roller 42 falls toward the returning conveyance channel 26, i.e. the returning conveyance guide 62, for delivery.

Figure 3:
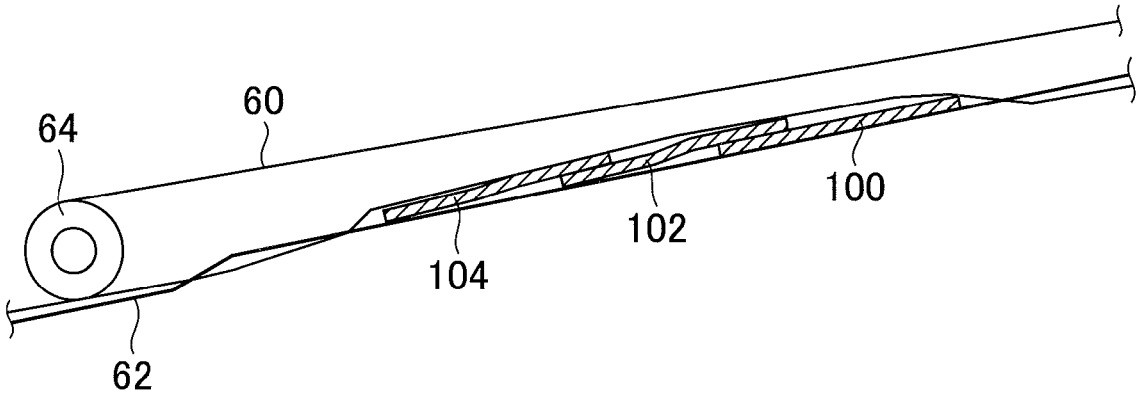
FIG. 3 is an explanatory view schematically showing bills conveyed in the returning and accumulating section in the embodiment of FIG. 1.

The returning conveyance guide 62 has a notch or the like, not shown, provided at its portion for avoiding the conveyor belt 60 from touching, and partially intersects with the lower length of the looped conveyor belt 60. Further, the returning conveyance guide 62 is partially formed into a mountain-like curved shape having its summit at a position 70 substantially corresponding to the middle of the bill conveyance path of the conveyor belt 60, i.e. the middle of the conveyor belt 60, and this mountain-like curved portion intersects with the lower length of the looped conveyor belt 60. In addition, in order to bring the lower length of the looped conveyor belt 60 and the mountain-like portion of the returning conveyance guide 62 to intersect with each other, the roller 64 is disposed such as to have its axis lower in height than the position 70. As illustrated in FIGS. 2 and 3, the returning conveyance guide 62 is disposed above and below the conveyor belt 60. The mountain-like portion of the returning conveyance guide 62 is also disposed above the conveyor belt 60. The length of the conveyance guide 62 is greater than the length of the conveyor belt 60.

In the present embodiment, since the returning conveyance guide 62 partially intersects with the lower length of the looped conveyor belt 60, when a bill enters between the conveyor belt 60 and the returning conveyance guide 62, as shown in FIG. 3, for example, the conveyor belt 60 is warped upward with respect to the returning conveyance guide 62 due to the thickness of the entered bill, thereby pinching the bill.

Returning to FIG. 2, the returning conveyance channel 26 composed as described above is provided with a bill stopper 80, conveying bill sensors 82, a returning bill sensor 84, bill discharging rollers 86, and a returning bill guide plate 88 to compose the returning and accumulating section 28.

The bill stopper 80 is installed in the vicinity of the rollers 66 of the conveyor belt 60, and has an abut guide 90 and a rotary fulcrum 92. The abut guide 90 functions as damming a bill in conveyance over the return conveyor channel 26, and the rotary fulcrum 92 functions as allowing the abut guide 90 to pivot, thereby moving the abut guide 90 from its standby position to its position of damming a bill, or from its position of damming a bill to its standby position.

The conveying bill sensors 82 are adapted for sensing that a bill is being conveyed on the returning conveyance channel 26. In the present embodiment, the conveying bill sensors 82 are optical sensors, each of which has a light-emitting element and a light-sensitive element, and detects when the light from the light-emitting element is blocked with a bill to determine the bill being conveyed over the returning conveyance channel 26.

The returning bill sensor 84 is installed in the vicinity of the discharge slot 30, and is adapted for sensing that a bill has been conveyed to the vicinity of the discharge slot 30. In the present embodiment, the returning bill sensor 84 is an optical sensor, which has a light-emitting element and a light-sensitive element, and detects when the light from the light-emitting element is blocked with a bill to determine that the bill has been conveyed to the discharge slot 30.

The bill discharging rollers 86 are adapted for sending out a bill to the discharge slot 30. In the present embodiment, the bill discharging rollers 86 are disposed one above the other as a pair on the side of the discharge slot 30 with respect to the returning bill sensor 84 to send out a bill pinched by the rollers 84 to the discharge slot 30.

The returning bill guide plate 88 is disposed above the returning conveyance guide 62 so as to face the latter to extend from the bill stopper 80 to the discharge slot 30. The returning bill guide plate 88 guides a bill dammed by the discharge slot 30, when being conveyed from the bill stopper 80 to the discharge slot 30, to the discharge slot 30 from above.

In the medium storing and advancing apparatus 10 configured in this way, a bill input from the bill inlet/outlet 12 is stored or fed out in the fashion as exemplified below. For example, when a customer inserts bills in lump into the bill inlet/outlet 12 in order to conduct a transaction such as deposition, the bills received by the bill inlet/outlet 12 are sent to the conveyance channel 18 on the conveyor belt 14 through the feeder 16, and are conveyed on the conveyance channel 18 to reach the discriminator 20.

The bills, when having reached the discriminator 20, are discriminated to be sorted into bills to be stored in the bill storage box 24 and bills to be discharged from the discharge slot 30, i.e. rejected bills. The bills to be stored in the bill storage box 24, i.e. the bills discriminated as authentic bills are further conveyed to the temporary storage 22 on the conveyance channel 18 to be temporarily stored therein. Thereafter, the customer operates the display device or input device, not shown, to confirm the monetary amount of the bills inserted by himself or herself or inform the medium storing and feeding-out apparatus 10 of his or her decision of the deposit of money. In turn, the medium storing and feeding-out apparatus 10 causes the bills temporarily stored in the temporary storage 22 to be carried to the bill storage box 24 over the conveyance channel 18 to be stored therein.

By contrast, a rejected bill determined to be returned by the discriminator 20 is conveyed toward the returning and accumulating section 28 on the conveyance channel 18, and is pinched by the feed roller 40 and the driven roller 42 disposed short of the returning and accumulating section 28 to be delivered to the returning and accumulating section 28, in which the rejected bill is brought to enter between the conveyor belt 60 and the returning conveyance guide 62 of the returning and accumulating section 28. At this time, the bill stopper 80 turns about the rotary fulcrum 92 to bring the abut guide 90 to the position of blocking the returning conveyance channel 26 to interfere with the conveyance of the bills.

The conveyor belt 60 starts to rotate in time with the sensor 50 having sensed the front end of a bill, and stops at predetermined timing. In the present embodiment, the "predetermined timing" is the time when the sensor 50 is to stop sensing a bill, that is, when a predetermined period of time has elapsed since the rear end of a bill having its front end already sensed passed the sensor 60. In more detail, the conveyor belt 60 starts to rotate in time with the sensor 50 having sensed the front end of a bill for starting the conveyance of the bill, and moves the bill until the tongue piece 48 of the tongue piece roller 46 abuts on the rear end of the bill on the conveyor belt 60, then stopping.

In this way, the conveyor belt 60 stops rotating at the predetermined timing when the bill moves to the position at which the tongue pieces 48 abut on the rear end of the bill, whereupon the tongue pieces 48 of the rotating tongue piece roller 46 start slapping the rear end of the bill to continuously press it against the returning conveyance guide 62. That makes it possible to hold down a bill, even when curved, having its rear end tending to lift up.

Thereafter, a bill following thereto is conveyed on the conveyance channel 18 to the feed roller 40 and the driven roller 42, and is pinched therebetween to be delivered to the returning and accumulating section 28. At the same time, the front and rear ends of the bill are sensed by the sensor 50. When the predetermined timing elapses after the sensor 50 sensed the rear end of the following bill, the conveyor belt 60 stops the conveyance of the bill. Thus, the bill previously delivered to the returning and accumulating section 28 moves on the conveyor belt 60, and the front end of the following bill rides over the rear end, pressed by the tongue pieces 48, of the preceding bill. Both are, as exemplified in FIG. 3, conveyed, while superimposed, toward the discharge slot 30 by the conveyor belt 60.

In FIG. 3, shown is how a plurality of bills 100, 102 and 104 are conveyed in series from the conveyance channel 18 in the returning and accumulating section 28 via the feed roller 40 and the driven roller 42. In FIG. 3, over the rear end of the preceding bill 100, the front end of the bill 102 conveyed following thereto rides, while on the rear end of the bill 102 the front end of the further following bill 104 rides.

In this way, when all the rejected bills are delivered in series to the returning and accumulating section 28, the conveyor belt 60 runs for the predetermined period of time so as to strike the leading ends of the bills 100, 102 and 104 against the abut guide 90 of the conveyance stopper 80 in series to superimpose those one on the other.

Thereafter, when the conveyance stopper 80 turns about the rotary fulcrum 92 to cause the abut guide 90 to move from its position of damming bills to its standby position, the conveyor belt 60 conveys the superimposed bills toward the discharge slot 30 to discharge the bills in lump from the discharge slot 30 for returning them to the customer.

As described above, in the instant embodiment, the tongue piece roller 48 is provided coaxially with the feed roller 40, and, when bills sent in series on the conveyance channel 18 are delivered to the returning and accumulating section 28, the tongue pieces 46 of the tongue piece roller 46 slap the rear end of a delivered bill so as to orient the latter downward to thereby superimpose the front end of the following bill onto the downward-oriented rear end of the preceding bill. Therefore, even when the rear end of the preceding bill is curved so as to turn upward, it is possible to prevent the front end of the following bill from knocking the rear end of the preceding bill, which makes it possible to prevent a so-called accumulation jam from occurring.

Further, in the present embodiment, since the returning conveyance guide 62 is partially formed into a mountain-like shape, even when a plurality of bills pinched between the returning conveyance guide 62 and the conveyor belt 60 cause part of the conveyor belt 60 to be warped more greatly than the remaining part thereof, it is possible to narrow a gap formed between the returning conveyance guide 62 and the conveyor belt 60, thus preventing the pinching power by the returning conveyance guide 62 and the conveyor belt 60 from lowering. Therefore, even in the case where a large number of bills are conveyed, e.g. where a series of bills continue in the conveying direction to the extent approximately half of the length of the conveyor belt 60, it is possible to adequately pinch the bills between the returning conveyance guide 62 and the conveyor belt 60, thus ensuring the bills to be fed toward the discharge slot 30.

Figure 4:
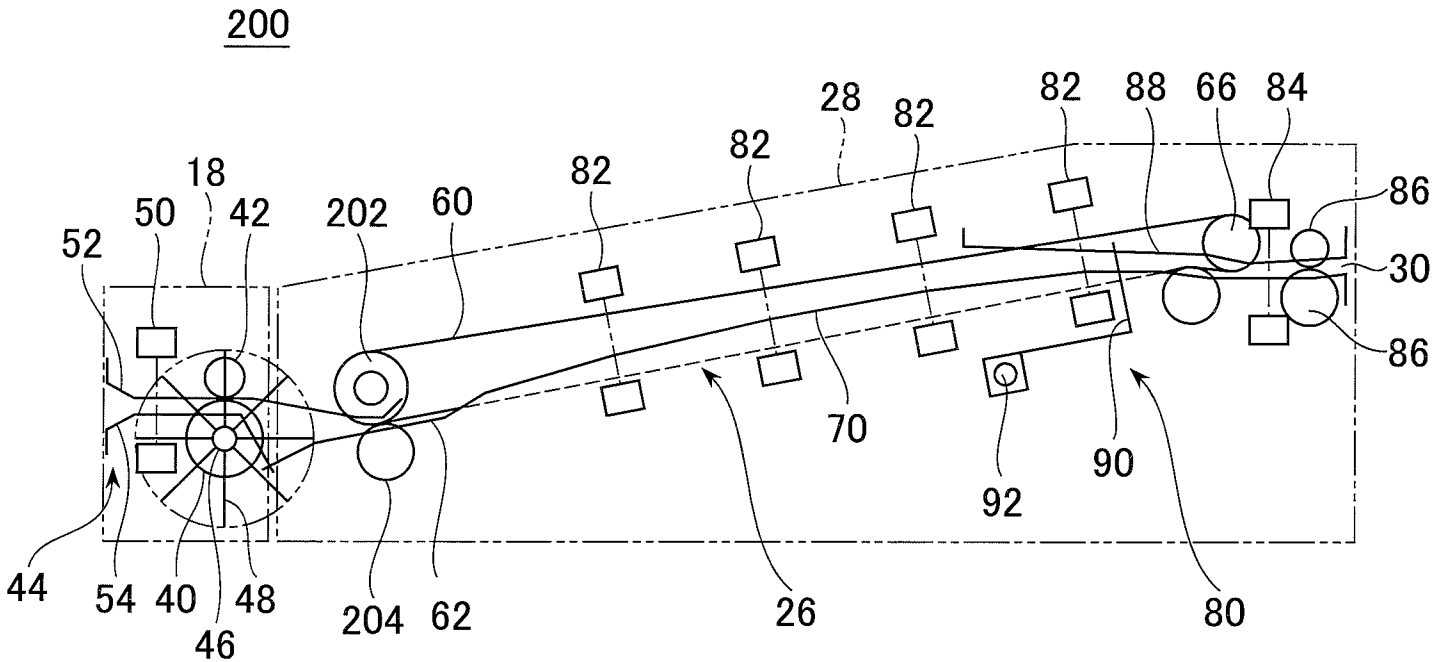
FIG. 4 is an enlarged view schematically showing a returning and accumulating section and conveyance channels in an alternative embodiment of a medium storing and advancing apparatus according to the present invention.

A medium storing and feeding-out apparatus 200, which will be described with reference to FIG. 4 as an alternative embodiment of a medium storing and feeding-out apparatus of the present invention, is substantially the same as the medium storing and feeding-out apparatus 10 except that the medium storing and feeding-out apparatus 200 includes a bill feed-out roller 202 provided coaxially with the roller 64 and a mating driven roller 204 which is provided so as to mate, and driven by, the bill feed-out roller 202.

The bill feed-out roller 202 is attached coaxially with the roller 64 installed upstream in the conveying direction of the conveyor belt 60 to rotate at the same rate as the roller 64. In FIG. 4, the roller 202 is shown although the roller 64 is not visible since located behind the roller 202.

The mating driven roller 204 is disposed under the bill feed-out roller 202 so as to mate the latter. The mating driven roller 204 includes a spring member, not shown, which presses the roller 204 against the bill feed-out roller 202 to cause the roller 204 to be driven by the bill feed-out roller 202.

Thus, since the medium storing and feeding-out apparatus 200 has the bill feed-out roller 202 and the mating driven roller 204, the bill feed-out roller 202 rotates while the roller 64 rotates. In turn, the mating driven roller 204 as well rotates so as to be driven following the bill feed-out roller 202 to cause a bill to pass between the bill feed-out roller 202 and the mating driven roller 204. It is thereby possible for the bill feed-out roller 202 and the mating driven roller 204 to assist the conveyance of the bill pinched by the feed roller 40 and the driven roller 42.

In detail, when a preceding bill having a crease or rift is fed into the returning and accumulating section 28, the bill can have its crease or rift pressed by the bill feed-out roller 202 and the mating driven roller 204, and can have its rear end slapped by the tongue pieces 48 to be oriented downward and further superimposed by the front end of a bill following thereto. Further, the following bill is fed to the conveyor belt 60 by the bill feed-out roller 202 and the mating driven roller 204, which makes it possible to apply to the following bill force for riding over the crease or rift of the preceding bill. Therefore, it is possible to prevent a so-called accumulation jam from occurring due to the following bill otherwise being caught on the crease or rift of the preceding bill.

In addition, in order to prevent a bill fed by the bill feed-out roller 202 and the mating driven roller 204 from knocking the bill stopper 80 to buckle due to its own momentum, it is necessary to design the lengths of the conveyor belt 60 and the conveyance guide 62 so as to space the bill stopper 80 from the bill feed-out roller 202 by an appropriate distance.

The entire disclosure of Japanese patent application No. 2008-179600 filed on Jul. 9 2008, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

The invention claimed is:

1. A medium storing and feeding-out apparatus storing and feeding out a medium, comprising:

a conveyance channel conveying the medium;

a discharge slot discharging the medium;

a conveyor belt receiving the medium conveyed on said conveyance channel to convey the medium toward said discharge slot;

a guide arranged to face said conveyor belt along the entire length of the conveyor belt and having a mountain-like portion that has a mountain-like shape to convey said medium toward said discharge slot by pinching said medium between said conveyor belt and said guide over the entire mountain-like portion, a portion of the mountain-like shape intersecting with said conveyor belt, and said guide being arranged so as to avoid touching said conveyor belt;

a feed roller arranged between said conveyance channel and said conveyor belt for delivering the medium conveyed on said conveyance channel to said conveyor belt; and a tongue piece roller arranged coaxially with said feed mile and having an outer circumference on which a plurality of tongue pieces are arranged so as to have a portion superimposed on a rear end of the medium delivered from said feed roller to said conveyor belt, the tongue piece roller rotating so that said tongue pieces slap the rear end of the medium delivered from said conveyance channel to said conveyor belt to orient the rear end downward, the downward-oriented rear end being superimposed with a front end of a following medium to be conveyed.

2. A medium storing and feeding-out apparatus storing and feeding out a medium, comprising:

a conveyance channel conveying the medium;

a discharge slot discharging the medium;

a conveyor belt receiving the medium conveyed on said conveyance channel to convey the medium toward said discharge slot, said conveyor belt being moved by first and second rollers rotating, said first and second rollers being respectively disposed upstream and downstream in a conveying direction;

a guide arranged to face said conveyor belt along the entire length of the conveyor belt and having a mountain-like portion that has a mountain-like shape to narrow a gap formed between said guide and said conveyor belt to convey said medium toward said discharge slot by pinching said medium between said conveyor belt and said guide over the entire mountain-like portion;

a feed roller arranged between said conveyance channel and said conveyor belt for delivering the medium conveyed on said conveyance channel to said conveyor belt;

a tongue piece roller arranged coaxially with said feed roller and having an outer circumference on which a plurality of tongue pieces are arranged so as to have a portion superimposed on a rear end of the medium delivered from said feed roller to said conveyor belt, the tongue piece roller rotating so that said tongue pieces slap the rear end of the medium delivered from said conveyance channel to said conveyor belt to orient the rear end downward, the downward-oriented rear end being superimposed with a front end of a following medium to be conveyed, and a feed-out roller arranged between said conveyance channel and said conveyor belt for receiving the medium from said feed roller to send the medium to said conveyor belt, said feed-out roller being provided coaxially with said first roller.

3. A medium storing and feeding-out apparatus storing and feeding out a medium, comprising:

a conveyance channel conveying the medium;

a discharge slot discharging, the medium:

a conveyor belt receiving the medium conveyed on said conveyance channel to convey the medium toward said discharge slot;

a guide arranged to face said conveyor belt along the entire length of the conveyor belt and having a mountain-like portion that has a mountain-like shape to narrow a gap formed between said guide and said conveyor belt to convey said medium toward said discharge slot by pinching said medium between said conveyor belt and said guide over the entire mountain-like portion, the mountain-like portion being disposed above a portion of the conveyor belt:

a feed roller as arranged between said conveyance channel and said conveyor belt for delivering the medium conveyed on said conveyance channel to said conveyor belt; and a tongue piece roller arranged coaxially with said feed roller and having an outer circumference on which a plurality of tongue pieces are arranged so as to have a portion superimposed on a rear end of the medium delivered from said feed roller to said conveyor belt, the tongue piece roller rotating so that said tongue pieces slap the rear end of the medium delivered from said conveyance channel to said conveyor belt to orient the rear end downward, the downward-oriented rear end being superimposed with a front end of a following medium to be conveyed.

4. The medium storing and feeding-out apparatus according to claim 3, wherein said guide has an elongated end positioned at the tongue piece roller such that the rear end of the medium is slapped by said tongue piece roller toward said guide.

5. The medium storing and feeding-out apparatus according to claim 3, wherein the medium is slapped such that the rear end of the medium contacts the guide.

6. The medium storing and feeding-out apparatus according to claim 3, wherein the guide is disposed above and below the conveyor belt.

7. The medium storing and feeding-out apparatus according to claim 3, wherein the guide is curved.

8. The medium storing and feeding-out apparatus according to claim 3, wherein said length extends along a direction of conveyance of the medium conveyed by the conveyor belt.

9. The medium storing and feeding-out apparatus according to claim 3, wherein said length is smaller than a length of the guide.

* * * * *